United States Patent [19]

Akerblom

[11] 3,930,905

[45] Jan. 6, 1976

[54] METHOD OF MANUFACTURING AN OBJECT OF SILICON STEEL

[75] Inventor: Carl-Artur Akerblom, Surahammar, Sweden

[73] Assignee: Allmanna Svenska Elektriska Aktiebolaget, Vasteras, Sweden

[22] Filed: Oct. 11, 1973

[21] Appl. No.: 405,492

[30] Foreign Application Priority Data

Oct. 26, 1972 Sweden ..... 13813/72

[52] U.S. Cl. ..... 148/113; 148/31.5; 148/122; 428/432; 428/471

[51] Int. Cl.[2] ..... H01F 1/04

[58] Field of Search ..... 148/31.5, 113, 111, 122, 148/6.3, 13.1; 117/125, 127, 129, 135.1, 221, 234; 106/73.3; 428/432, 471

[56] References Cited

UNITED STATES PATENTS

| | | | |
|---|---|---|---|
| 2,394,030 | 2/1946 | Wainer | 106/73.3 |
| 2,501,846 | 3/1950 | Gifford | 148/100 |
| 2,689,185 | 9/1954 | Soyck | 106/73.3 |
| 3,396,044 | 8/1968 | Satterfield | 148/13.1 |
| 3,627,594 | 12/1971 | Yamamoto et al. | 148/113 |
| 3,676,227 | 7/1972 | Matsumoto et al. | 148/111 |
| 3,697,322 | 10/1972 | Lee et al. | 117/234 |
| 3,793,073 | 2/1974 | Kitayama et al. | 148/31.5 |
| 3,827,922 | 8/1974 | Boggs et al. | 148/113 |
| 3,832,245 | 8/1974 | Akerblom | 148/113 |

OTHER PUBLICATIONS

Ban, Y. S., et al.; Thin Films of Semiconductors & Dielectrics, in Journ. Mater. Sci., 5(11), 1970 pp. 978–982.

*Primary Examiner*—Walter R. Satterfield

[57] ABSTRACT

A steel object, such as sheet and strip for motors, is provided with a heat-resistant, electrically insulating coating in the form of a layer of calcium titanate. An intermediate layer of silicate may be provided between the steel surface of the object and the layer of titanate. The intermediate layer is preferably a silicate of one or more alkaline earth metals or of aluminum, and especially a silicate of magnesium.

The coating of calcium titanate may also contain a vanadium compound. Likewise, a layer of phosphate may be provided on the outside of the layer of titanate.

10 Claims, 2 Drawing Figures

METHOD OF MANUFACTURING AN OBJECT OF SILICON STEEL

BACKGROUND OF THE INVENTION

1. Field of the Invention

The invention relates to the provision of an insulating coating on an object of steel, especially silicon steel.

2. The Prior Art

When manufacturing sheet or strip material of silicon steel, so-called electrical sheet or strip, the material is subjected after rolling to a heat treatment at a temperature of from about 850° to 1350°C in order to produce grain growth of the crystals which is necessary if the sheet or strip material is to obtain the necessary magnetic properties.

Before the heat treatment, the sheet or strip material is coated with chemicals which during the heat treatment are to form an electrically insulating protective layer on the material. One such known protective layer may consist of a reaction product of silicon dioxide formed on the surface of the sheet or strip material and an oxide or hydroxide of an alkaline earth metal applied thereon, usually magnesium, or of essentially unreacted alkaline earth oxide. The application of the protective layer on the surface of the material is performed by suspending the alkaline earth metal oxide or hydroxide in water, then coating it on to the sheet or strip material in an even layer, after which the sheet or strip material is subjected to the heat treatment previously mentioned, at a temperature of from 850°C to 1,350°C in hydrogen atmosphere, and if a well-developed glass film is to be formed on the sheet or strip material the temperature should amount to about 1,000°C to 1,350°C. The hydroxide which is included in the suspension from the start or which is formed from the oxide by reaction with water, liberates water during the heating of the sheet or strip material, which water, at temperatures below the last mentioned range, is able to oxidize silicon in the steel to silicon dioxide without the iron being oxidized at the same time. The oxide which is formed from the hydroxide during the liberation of water, or which was possibly added from the start and has avoided hydration, reacts with the silicon dioxide at temperatures in the range from about 1,000° to 1,350°C, thus forming a well-developed glass film on the surface of the sheet or strip material, as mentioned earlier. The glass film can also be produced by the use of a carbonate of an alkaline earth metal. The carbon dioxide which the carbonate liberates upon being heated can oxidize silicon to silicon dioxide without the iron being oxidized. When the silicon dioxide has been produced, the formation of the glass continues in the manner described above. Any excess of oxide which has not reacted during the glass formation acts as spacer material between adjacent layers of the sheet or strip material whether these occur as turns in a roll or as laminae in a stack, thus preventing the layers from sticking or sintering together.

The process described above involving heat treatment at a temperature in the range from about 1,000° to 1,350°C, is normal in the manufacture of silicon steel with grain orientation where the formation of a glass film is particularly important.

Silicon steel without grain orientation normally contains a few tenths percent by weight aluminium, which means that no real glass film is formed during the heat treatment, even if this is carried out in the temperature range of from 1,000°C to 1,350°C. The alkaline earth metal oxide instead remains as a layer serving principally as a spacer material. This is quite sufficient as a protective layer for silicon steel without grain orientation. In this case, it is also possible to replace the oxide or hydroxide of the alkaline earth metal normally used, by aluminium oxide or hydroxide.

A protective coating of silicate of the kind described above has an electrical insulating resistance which is unsatisfactory for many purposes, and therefore the protective coating is often reinforced by treating it with phosphoric acid or metal phosphates, for example according to the methods which are described in the Swedish Pat. specification 129,585. Such a treatment with phosphoric acid or phosphates can also be made directly on the pure sheet material.

When applying phosphate on said protective coating of silicate, the protective coating may become porous. This is due to the phosphate penetrating into the silicate layer which loosens it. The penetration of the phosphate also causes a deterioration of the otherwise good adhesion of the coating to the sheet and also a deterioration of the tenacity of the coating and therefore of its resistance to, for example, bending. The loosening of the coating also means that it can easily be burst away from the sheet in the subsequent annealing at a temperature of about 800°C which is carried out in order to remove inner tensions in the sheet, for there is a risk of gases penetrating into the sheet material because of the porosity of the coating and causing the unfavourable effect. In the subsequent annealing in hydrogen atmosphere of phosphate coatings, the phosphate layer may be reduced, thus strongly imparing the insulating resistance.

The protective layer which is obtained by treating a pure sheet material with phosphate becomes porous and shows bad adhesion to the sheet material. The porosity is a disadvantage with regard to the corrosion resistance as well as with regard to insulating properties.

SUMMARY OF THE INVENTION

According to the present invention it has proved possible to provide objects of steel, especially of silicon steel, in the form of sheet or in other form, which are provided with a protective coating which simultaneously shows great density, excellent adhesion to the underlying material, great electrical insulating resistance and good resistance to annealing in a hydrogen atmosphere and which is therefore superior to previously known protective coatings.

The present invention relates to an object of steel, especially of silicon steel, such as in the form of sheet and strip for motors, generators and transformers and in the form of rods for magnetic cores which is provided with a heat-resistant, electrically insulating coating which is characterised in that the insulating coating comprises a layer of calcium titanate.

The calcium titanate forms a very dense layer with high electrical insulating resistance and with extremely good adhesion to the sheet. Because the layer is so dense it protects the underlying material, that is the silicate layer or the sheet if no silicate layer is present, against the effect of phosphate. This also means that more acid phosphate solutions can be used when applying phosphate, which increases the glazing on the surface of the layer. Furthermore, it has been proved that, if active magnesium oxide is used to form the silicate ıyer, a magnesium silicate layer will be formed closest ɔ the steel surface even if aluminium is present in the :eel.

The thickness of the layer of calcium titanate is suitbly 0.1 – 5 microns, preferably 0.1 – 1 micron.

Between the layer of the titanate and the steel surface f the object there is preferably arranged an intermedite layer of a silicate known per se as material in proective layers for silicon steel, such as a layer of the licate described above consisting of a reaction prodct of silicon dioxide formed on the steel surface and a ompound of alkaline earth metal or aluminium aplied thereon. This preferred embodiment of the invenon is particularly advantageous if the object consists f a silicon steel with grain orientation. The silicon ontent in such steel is normally around three percent y weight.

Magnesium is particularly preferred as the alkaline arth metal in the intermediate layer of silicate, but alcium, barium and strontium may also be used.

The thickness of the intermediate layer of the silicate from unimolecularly up to around 5 microns, preferbly 0.1 – 1 microns.

Previously proposals have been made to apply a proective layer on silicon steel by applying on the surface, fter heat-treating the sheet in order to achieve formaon of silicon dioxide on the surface, a mixture of ıagnesium oxide or hydroxide and titanium dioxide or ydroxide on the surface. In this case a film is formed onsisting of one single layer. Such a film has an infeor density and an adhesion to the sheet which is conderably inferior to that of a titanium layer according ɔ the present invention which is formed on an intermeiate layer of silicate.

The layer of titanate can also be in direct contact ·ith the steel surface of the object, which is mostly the ase when coating objects of silicon steel without grain rientation and rods for magnetic cores. The silicon ontent in such steel is normally within the range from .3 to 5 percent by weight.

It has proved possible to reduce the remagnetization ɔsses both in silicon steel with grain orientation and in licon steel without grain orientation, and with regard ɔ the first mentioned type of silicon steel it is also ossible to improve the insulating resistance considerally by incorporating a vanadium compound in the proective coating, if an intermediate layer is used, preferbly in an amount which stoichiometrically correɔonds to 0.001 to 10 g $V_2O_5$ g per square meter of the ırface of the object.

The invention also relates to a method of manufacıring an object of steel, especially silicon steel, such as ı the form of sheet and strip for motors, generators nd transformers and in the form of rods for magnetic ores, in which the object is provided with a heat-resistnt, electrically insulating coating, characterised in that n insulating coating comprising a layer of calcium tanate is arranged on the sheet.

According to a particularly preferred embodiment of ıe invention, an intermediate layer of silicate is ɔrmed between the steel surface of the object and the ıyer of titanate. This is preferably done in the same ·orking operation as the layer of titanate is applied. 'he result can be obtained by applying on the object articles of a hydroxide of an alkaline earth metal or of luminium and/or a carbonate of an alkaline earth ıetal and/or an oxide of an alkaline earth metal or of luminium and particles of calcium titanate and/or of titanium dioxide, and if titanium dioxide is used also calcium carbonate is added, which the ability to form calcium titanate with the titanate dioxide, after which the object with the applied particles is subjected to heating to at least 850°C, preferably to 1,000°C to 1,350°C. In this way the intermediate layer of silicate as well as the layer of calcium titanate are formed.

The titanium dioxide used consists preferably of anatase.

The alkaline earth metal is of the kind exemplified earlier. As mentioned, magnesium oxide is particularly preferred, preferably in active form, because it has then proved possible to manufacture a well-developed glass film even if the steel contains aluminium.

If calcium carbonate is used to form the silicate in the intermediate layer, the quantity of the calcium carbonate must of course be sufficient to provide the desired thickness in the silicate layer and, in addition, be sufficient to react with the titanium dioxide, that is in addition to such quantity, it must be in an amount which is substantially equivalent to that of the titanium dioxide.

The quantity of the particle material which are applied to form the intermediate layer of silicate, that is the hydroxide of alkaline earth metal or aluminium and/or the carbonate of alkaline earth metal and/or the oxide of alkaline earth metal or of aluminium if from 3 to 30 g/m² of the surface of the object. The size of the particles is less than 250 microns and preferably less than 50 microns.

The quantity of titanium and titanium dioxide is from 5 to 100, preferably from 25 to 50, parts by weight counted as $TiO_2$ for 100 parts by weight MgO or the equivalent quantity of another substance forming the intermediate layer of silicate. The quantity of calcium carbonate for forming with titanium dioxide constitutes an amount which is substantially stoichiometrical with the amount of titanium dioxide used. The main part of the particles of titanate and of titanium dioxide suitably have a grain size less than 10 microns, preferably less than 5 microns. The calcium calcium carbonate is added which has suitably has a grain size less than 25 microns if applied in particle form.

As mentioned previously, it is advantageous to incorporate a vanadium compound in the protective coating. A vanadium (V) compound or another vanadium compound than vanadium (V) compounds may then be used, which when they have been applied on the sheet are converted to vanadium (V) compounds at some stage of the treatment of the sheet. As examples of vanadium compounds which may be used may be mentioned vanadates of various kinds, such as ortho-, pyro-, metha-, and poly-vanadates of various metals such as alkaline earth metals, for example magnesium, calcium, barium and strontium, alunimium and titanium, and of ammonium, further corresponding vanadium acids. Besides vanadium, these compounds also contain oxygen. It is also possible to use other vanadium compounds than those containing ogygen, for example vanadium (V) carbide, but the last mentioned compound gives carburization at higher temperatures. Particularly preferred is vanadium (V) oxide. Preferably a quantity of vanadium compound is used which stoichiometrically corresponds to 0.001 – 10 g vanadium (V) oxide per square meter of the area of the object. The grain size of the vanadium compound, if applied in particle form, suitably amounts to from 1 to 25 microns.

The particle materials mentioned are supplied to the surface of the object suitably in the form of an aqueous suspension, but they can also be applied in dry form, in which case they are mixed and powdered on the surface of the object.

The heating of the object with the applied particles may be performed in nitrogen gas or hydrogen gas or another inert or reducing atmosphere, preferably in a batch annealing furnace. The temperature is raised continuously from ambient temperature to the temperature stated above. The time taken for the heating process is several hours and the time during which said temperature is maintained is also several hours.

It is also possible to apply the intermediate layer of silicate in one operation and the layer of titanate in another separate operation. In accordance with this embodiment there are first applied on the object particles of a hydroxide of an alkaline metal or of aluminum and/or a carbonate of an alkaline earth metal and/or an oxide of an alkaline earth metal or aluminium and the object with the applied particles is then subjected to heating to a temperature of at least 850°C, preferably to 1000°C to 1350°C for formation of the intermediate layer of silicate. After this there are applied on the object thus treated particles of calcium titanate and/or of titanium dioxide, and if titanium dioxide is used also calcium carbonate is added which has the ability to form a titanate with the titanium dioxide, after which the object with the applied particles is again subjected to heating to a temperature of at least 850°C, preferably to 1000° – 1350°C for formation of the layer of titanate. The first-mentioned heat treatment and also the last-mentioned one may be performed under the conditions stated previously. The materials and the quantities of the materials and the other conditions may be the same as in the previously described method when both layers are applied in one operation.

It is also possible to produce insulated objects according to the present invention without using an intermediate layer of silicate. The layer of titanate is then applied directly on the surface of the object. According to this embodiment particles of calcium titanate and/or of titanium dioxide are applied, and if titanium dioxide is used also calcium carbonate is added with the titanium dioxide to form a titanate with the titanium dioxide, after which the object with the applied particles is subjected to heating to at least 850°C, preferably to 1000° – 1350°C. The materials, the quantity of the materials and the other conditions may be the same as in methods described previously.

A layer of a phosphate may be arranged outside the layer of titanate. This can be made in conventional manner, for example in the manner described in the Swedish Pat. specification 129,585.

BRIEF DESCRIPTION OF THE DRAWINGS

The invention will be explained more closely by describing a number of embodiments with reference to the accompanying drawings in which FIG. 1 schematically shows a device for applying a protective layer as one stage in the manufacture of an object of silicon steel in accordance with the present invention.

DESCRIPTION OF THE PREFERRED EMBODIMENTS

Figure 1:
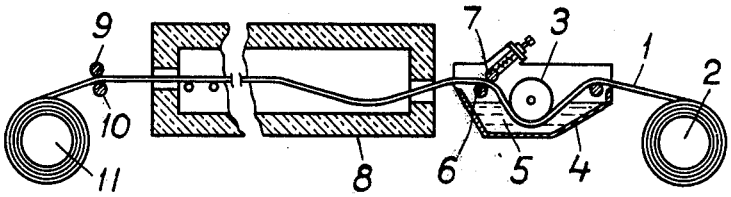

In the figure, 1 designates a strip of silicon steel. The strip is drawn from a coil on a reel 2 and passes under a roll 3 which rotates in a pan 4 containing a suspension 5 of the particulate material with which the strip is to be coated. The strip is then passed between wiping rollers 6 and 7, which are suitably covered with rubber, and into a furnace 8 where it is dried at a temperature of about 100°C for about 30 sec. before being wound up on a reel 11 after passing through transport rollers 9 and 10. The concentration of the particulate material is adjusted with respect to the profile of the rubber rollers 6 and 7 and to the roller pressure so that desired layer thickness of the coating material is obtained. The coil on the reel 11 is annealed in a batch annealing furnace at a temperature of from 1,000°C to 1,350°C in a hydrogen atmosphere for several hours, thus forming a protective layer on the strip.

The suspension may also be applied, for example, by spraying.

The following examples illustrate suitable compositions of the suspension 5 and its manufacture. In these examples the expression "parts" means parts by weight and the expression "percent" means percent by weight.

EXAMPLE 1

100 parts of magnesium oxide consisting of particles of which up to 95 percent have a grain size less than 5 microns and otherwise a grain size less then 25 microns. 20 parts of titanium dioxide in the form of anatase having a grain size less than 5 microns and 20 parts of calcium carbonate (precipitated from solution) having a grain size less than 25 microns are suspended in 1,300 parts of water. The suspension is applied within 1 hour on a strip of silicon steel, which has been pretreated to give orientated crystals and has a thickness of 0.3 mm. When the strip has been dried it is heated gradually in hydrogen as described above.

EXAMPLE 2

100 parts of magnesium oxide, 30 parts of titanium dioxide and 30 parts of calcium carbonate, all being of the same type as those described in Example 1, are suspended in 1,000 parts of water. The suspension is applied in the same manner as described in Example 1.

EXAMPLE 3

60 parts of magnesium oxide having a grain size less than 5 microns, 40 parts of magnesium hydroxide having a grain size of less than 10 microns, 15 parts of titanium oxide in the form of anatase having a grain size less than 5 microns and 15 parts of calcium carbonate having a grain size less than 25 microns are suspended in 1,000 parts of water. The suspension is applied in the same manner as described in Example 1.

EXAMPLE 4

100 parts of magnesium oxide, 30 parts of titanium dioxide, 30 parts of calcium carbonate, all being of the same type as those described in Example 1, and also 6 parts of vanadium (V) oxide having a grain size of less than 5 microns are suspended in 1,300 parts of water. The suspension is applied in the same manner as described in Example 1.

EXAMPLE 5

100 parts of titanium dioxide in the form of anatase consisting of particles less than 5 microns and 100 parts of calcium carbonate (precipitated from solution) having a grain size less than 25 microns are suspended in 800 parts of water. The suspension is applied within 24 hours on a strip of silicon steel without grain orientation and with a thickness of 0.5 mm. When the strip has been dried it is heated gradually in hydrogen as described above.

After the object has been coated with the titanate layer it can be used, for example, as sheet and strip for motors, generators and transformers. However, the protective coating is normally reinforced in the usual manner by treatment with phosphoric acid or metal phosphates according to well-known methods, for example according to Swedish patent specification No. 129,585. Examples of treatment with phosphate are given in the following.

EXAMPLE 6

A strip which has been treated in any of the ways described in Examples 1 to 5 is freed of the excess coating of the protective coating by brushing. It is then dipped in a solution consisting of 700 parts of phosphoric acid, 10 parts of magnesium oxide and 290 parts of water. The excess solution is squeezed off with the help of grooved rubber rollers having a profile depth of 0.1 mm and with 24 threads per inch. The strip is then subjected to heat treatment at a temperature of 800° to 900°C for 2 to 3 minutes.

EXAMPLE 7

A strip which has been treated in any of the ways described in Examples 1 to 5 is pickled with 10 percent sulphuric acid for 15 to 30 seconds. When the strip has been rinsed with water, a magnesium orthophosphate (or other alkaline earth metal phosphate) is applied on the strip in the form of an aqueous solution containing 100 g of magnesium orthophosphate per litre of solution. The coating is then baked in in a furnace at a temperature of from 800° to 900°C for 2 to 3 minutes, a meta-phosphate layer then being formed.

Figure 2:
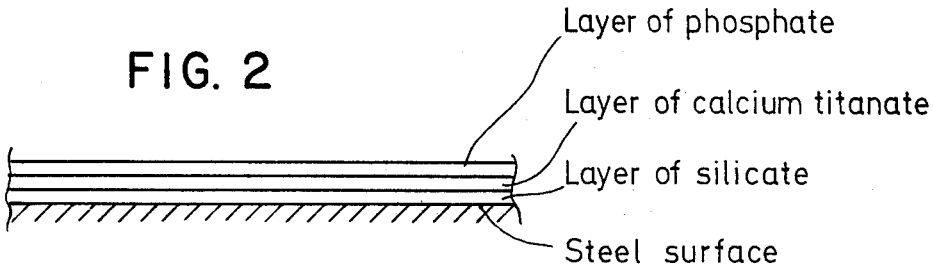
FIG. 2 shows a silicon steel strip provided with a coating according to the invention.

FIG. 2 shows a strip of silicon steel with successive layers of silicate, calcium titanate and phosphate thereon.

I claim:

1. An object of silicon steel having a heat-resistant, electrically insulating coating firmly thereto, said heat-resistant, insulating coating comprising a layer of a thickness of 0.1–5 microns consisting essentially of calcium titanate.

2. An object according to claim 1, having an intermediate layer consisting essentially of silicate between the steel surface of the object and the layer of titanate.

3. An object according to claim 2, in which the intermediate layer consists essentially of a silicate of a substance selected from the group consisting of alkaline earth metals and aluminum.

4. An object according to claim 2, in which the intermediate layer consists essentially of a magnesium silicate.

5. An object according to claim 1, in which the layer of calcium titanate is in direct contact with the steel surface of the object.

6. An object according to claim 1, in which the coating comprises a vanadium compound derived from a vanadium compound selected from the group consisting of vanadium (V) oxide and alkaline earth metal vanadates in an amount which stoichometrically corresponds to at least 0.001 g $V_2O \leqq$ per square meter of the surface of the object.

7. An object according to claim 2, in which the quantity of titanate in the coating stoichiometrically corresponds to 5 – 100 parts by weight $TiO_2$ for 100 parts by weight MgO or the equivalent quantity of another compound in the intermediate layer of silicate.

8. An object according to claim 1, having a layer of a phosphate outside the layer of titanate.

9. An object according to claim 2, in which the coating comprises a vanadium compound derived from a vanadium compound selected from the group consisting of vanadium (V) oxide and alkaline earth metal vanadates in an amount which stoichometrically corresponds to at least 0.001 g $V_2O_5$ per square meter of the surface of the object.

10. An object according to claim 2 having a layer of a phosphate outside the layer of titanate.

* * * * *